US005324394A

United States Patent [19]

Riley et al.

[11] Patent Number: 5,324,394

[45] Date of Patent: Jun. 28, 1994

[54] RECOVERY OF LI FROM ALLOYS OF AL- LI AND LI- AL USING ENGINEERED SCAVENGER COMPOUNDS

[75] Inventors: W. D. Riley, Albany; B. W. Jong, Corvallis; Collins, W. K.; S. J. Gerdemann, both of Albany, all of Oreg.

[73] Assignee: The United States of America as represented by the Secretary of the Interior, Washington, D.C.

[21] Appl. No.: 956,193

[22] Filed: Oct. 5, 1992

[51] Int. Cl.[5] ..... C25C 3/02

[52] U.S. Cl. ..... 204/68

[58] Field of Search ..... 204/68, 67, 64 T

[56] References Cited

U.S. PATENT DOCUMENTS 2,766,111 10/1956 Singleton ..... 204/67

4,588,485 5/1986 Cohen et al. ..... 204/64 T

FOREIGN PATENT DOCUMENTS 0709818 5/1965 Canada .

*Primary Examiner*—Kathryn Gorgos

*Attorney, Agent, or Firm*—E. Philip Koltos

[57] ABSTRACT

A method of producing lithium of high purity from lithium aluminum alloys using an engineered scavenger compound, comprising:

I) preparing an engineered scavenger compound by: a) mixing and heating compounds of TiO2 and Li2CO3 at a temperature sufficient to dry the compounds and convert $Li_2CO_3$ to $Li_2O$; and b) mixing and heating the compounds at a temperature sufficient to produce a scavenger $Li_2O.3TiO_2$ compound;

II) loading the scavenger into one of two electrode baskets in a three electrode cell reactor and placing an Al-Li alloy in a second electrode basket of the three electrode cell reactor;

III) heating the cell to a temperature sufficient to enable a mixture of KCl-LiCl contained in a crucible in the cell to reach its melting point and become a molten bath;

IV) immersing the baskets in the bath until an electrical connection is made between the baskets to charge the scavenger compound with Li until there is an initial current and voltage followed by a fall off ending current and voltage; and V) making a connection between the basket electrode containing engineered scavenger compound and a steel rod electrode disposed between the basket electrodes and applying a current to cause Li to leave the scavenger compound and become electrodeposited on the steel rod electrode.

7 Claims, 1 Drawing Sheet

RECOVERY OF LI FROM ALLOYS OF AL- LI AND LI- AL USING ENGINEERED SCAVENGER COMPOUNDS

FIELD OF THE INVENTION

The invention relates to a process for obtaining Li metal selectively recovered from Li-Al or Al-Li alloy scrap by: (1) removing Li from aluminum-lithium alloys at temperatures between about 400° C.–750° C. in a molten salt bath of KCl-LiCl using lithium titanate ($Li_2O.3TiO_2$) as an engineered scavenger compound (ESC); and (2) electrodepositing of Li from the loaded ESC to a stainless steel electrode. By use of the second step, the ESC is prepared for reuse. A molten salt bath is required in the invention because of the inability of molten aluminum alloys to wet the ESC.

BACKGROUND OF THE INVENTION

In fields where high stiffness-to-weight ratio materials are needed, aluminum-lithium alloys have achieved wide acceptance; however, in this field, producers of aluminum alloys are reluctant to recycle these alloys due to the fact that any introduction of Li into conventional Al alloy melts causes deleterious effects such as room temperature embrittlement or casting porosity.

Nevertheless, contemporary technology affords two principle approaches to removing Li. One approach utilizes the procedure of flux additions during melting of the scrap material followed by subsequent Li recovery from the slag. The next approach utilizes the procedure of vacuum distillation of the Li from bulk scrap during melting. Both of the procedures employed by current technology for Li removal require either additional processing steps or expensive vacuum distillation equipment.

Therefore, there is a need for a procedure that removes and recovers Li from Al-Li or Li-Al alloys that is inherently safer, more economical and characterized by fewer processing steps. Such a procedure would permit the Li-free aluminum fraction to be recycled in a conventional way and thereby provide a more direct technological process for recovery of Li metal values.

SUMMARY OF THE INVENTION

One object of the invention is to overcome the limitations and complexities of prior art processes for Li removal.

Another object of the invention is to overcome the limitations and complexities of prior art processes for Li removal by the use of an ESC capable of readily and selectively removing Li as a directly recyclable fraction.

A further object of the invention is to provide a method for overcoming the limitations and complexities of prior art processes for removing Li by utilizing an ESC of lithium titanate ($Li_2O.3TiO_2$) that is capable of readily and selectively removing Li as a directly recyclable fraction.

A still further object of the invention is to provide a method for readily removing Li metal free from the limitations and complexities of prior art processes in a manner so that the Li metal is protected from contamination by slag, by virtue of safely locking the Li metal securely within the lithium titanate ESC until the Li is electrodeposited as a high-purity product on a stainless steel electrode.

In general, the procedure of the invention is accomplished by suspending Al-Li alloy solids or turnings and borings in a molten salt bath of KCl-LiCl at temperatures of from about 400° C. to about 750° C. The solids or turnings are contained in an electrode basket of a three electrode cell primary reactor during the suspension step. Thereafter, an ESC is put into another electrode basket of said cell and this basket is then immersed in the molten salt bath. A third stainless steel electrode is placed in the bath in order to recover the electrodeposited Li metal, by virtue of an electrical connection made between the lithium titanate ESC and the Al-Li alloy. An instantaneous generation of current and voltage indicates that the reaction is taking place, and during the reaction, the Li is swiftly removed from the Al-Li alloy and taken up by the ESC. There is a rapid fall-off of current and voltage as the reaction nears completion. After the Li is removed from the Al-Li alloy, a small amount of current between the ranges of about 0.2 A–0.5 A is applied to the scavenger compound whereupon the Li is electrodeposited on the third stainless steel electrode. At this point, the $Li_2O.3TiO_2$ ESC is then ready for use in another cycle for Li separation.

Alternatively, the process of removing Li of the invention may be accomplished by melting Al-Li in a conductive crucible, such as a graphite crucible, at a temperature of about 750° C. under a LiCl-KCl flux, whereupon an electrode containing the ESC is inserted into the flux to allow the reaction to take place by virtue of an electrical connection made between the electrode and the crucible. Upon completion of the reaction, the Li entrained in the ESC is then electrodeposited as metallic Li on the stainless steel electrode, whereupon the ESC is ready to be used again for scavenging.

A third procedure for removing Li in the context of the invention is a continuous, two-reactor, processing system which utilizes the flow of molten Al-Li alloy and a solid ESC in separate porous ceramic tubes surrounded by the molten salt bath of KCl-LiCl in a primary reactor. Utilizing this procedure, the ESC is reactivated by electrodepositing the Li on a removable electrode in a second reactor, whereupon the ESC will then be ready for reuse in the primary reactor.

The foregoing and additional objects, features and advantages of the invention will become more apparent to those skilled in the art by reference to the accompanying detailed description of preferred embodiments, taken in conjunction with the accompanying drawings.

DETAILED DESCRIPTION OF THE INVENTION

EXAMPLE 1

Figure 1:
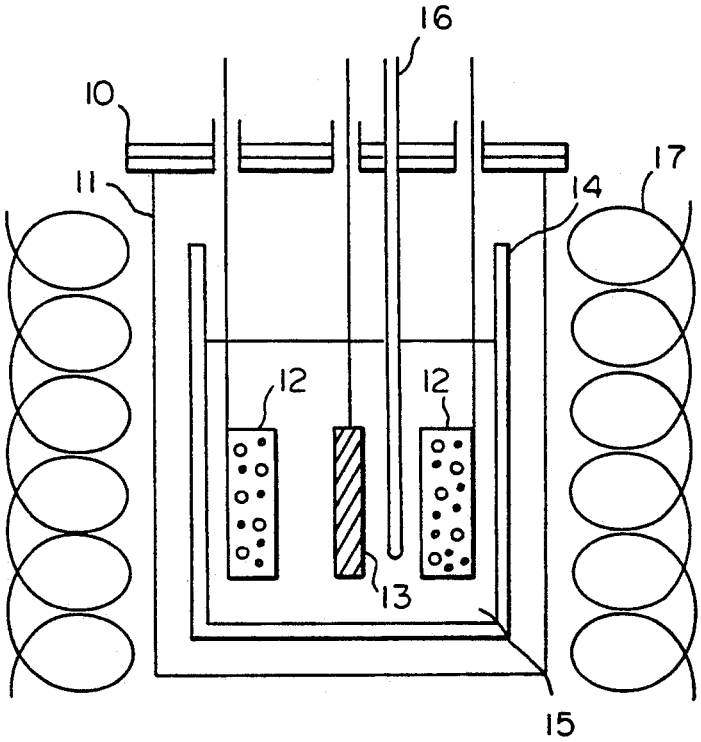
FIG. 1 depicts the three electrode reactor cell used for effecting removal of Li from Li-Al or Al-Li alloys using an ESC in accordance with the process of the invention.

The ESC, $Li_2O.3TiO_2$, is prepared by reacting well-mixed portions of 74 mol. % to about 76 mol. % of either anatase or rutile $TiO_2$ with from about 24 mol. % to about 26 mol. % $Li_2CO_3$ in a two-stage heating process.

The first stage is conducted at about 900° C. to dry the salts and to convert the $Li_2CO_3$ to $Li_2O$. After the initial 900° C. heating stage, the materials are remixed and heated to about 1,100° C. to obtain the final product of $Li_2O.3TiO_2$. The atomic structure of the ESC is orthorhombic; however, as Li is scavenged by the compound, the structure begins to take on a more hexagonal shape due to additional Li being incorporated into the ESC. As Li is removed from the structure during the electrodeposition stage, the ESC stays as the hexagonal form.

Reference is made to FIG. 1, wherein a three electrode cell reactor is employed to carry the Li removal reaction.

As can be seen from FIG. 1, there is depicted a stainless steel cell top 10, having a stainless steel cell base 11 and a pair of stainless steel electrode baskets 12. The cell top, cell base and stainless steel electrode baskets are made of 316 stainless steel. A stainless steel electrode 13 is disposed between the two stainless steel electrode baskets placed inside a ceramic crucible 14 in which a molten salt bath 15 of KCl-LiCl is contained. A thermocouple well 16 is disposed inside the cell and extends into the molten salt bath between the stainless steel electrode and one of the stainless steel electrode baskets. The three electrode cell reactor is surrounded by resistance heaters 17, and the electrode holders in the top of the cell are insulated from the cell top with ceramic inserts to prevent short circuits.

The ceramic crucible, in addition to being used to contain the molten salt bath, also electrically insulates the cell device.

In operation, the scavenger compound is loaded into one of the stainless steel electrode baskets 12 and the Al-Li alloy turnings, borings or solids are placed in the other stainless steel basket 12. The temperature of the resistance heaters 17 is adjusted to the melting point of the KCl-LiCl mixture contained in the ceramic crucible. The ratio of the KCl-LiCl mixture is adjusted so that the mixture melts at any temperature between about 400° C. to about 750° C. Upon reaching the melting point of the salt mixture, both baskets are immersed in the bath to initiate an electrical connection between the two electrode baskets. Table I lists the current and voltage generated during a series of experiments in this connection. In these experiments, the ratio of $Li_2O.3TiO_2$ to Al-Li alloy was varied from between about 0.5 to about 9. It was found that increasing the ratio of $Li_2O.3TiO_2$ does not affect the Li removal from the alloy. In each experiment, the Li level in the alloy was 2.1% and at the end of the experiments, approximately 90% of the Li was scavenged by the compound. The results of several experiments with the scavenger compound are shown in Table I.

| Experiment | Pct Li Removal | $Li_2O.3TiO_2$/ Alloy Ratio | Initial mV, μA | Ending mV, μA |
|---|---|---|---|---|
| A | 89 | 9 | 500, 2.4 | 74, 0.3 |
| B | 89 | 9 | 470, 2.2 | 190, 0.9 |
| C | 87 | 0.5 | 430, 2.1 | 420, 2.0 |
| D | 88 | 2 | 440, 2.1 | 350, 1.7 |

As can be seen from Table I, the voltage and current fall off as the scavenger compound is charged with Li. When the experiment has run to completion, the electrical connection is broken. A connection is made between the basket electrode which contains the ESC and the stainless steel rod electrode and a current of 0.2–0.5 A at 2.5 V DC is applied to cause the captured Li to leave the scavenger compound and become electrodeposited on the stainless steel electrode 13. The Li metal deposited on the stainless steel electrode had a purity of greater than 99.3% in all four experiments.

After the captured Li is electrodeposited on the electrode, the scavenger compound is ready for removal of additional Li from a fresh charge of Al-Li alloy. It was found that, in a ten-cycle experiment, the ESC lost neither structural stability nor its capacity for removing Li during the repeated cycles of absorption and electrodeposition.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of producing lithium of high purity from lithium aluminum alloys using an engineered scavenger compound, comprising:

I) preparing an engineered scavenger compound by:
a) mixing and heating compounds of $TiO_2$ and $Li_2CO_3$ at a temperature of about 900° C. to dry the $TiO_2$ and $Li_2CO_3$ and convert $Li_2CO_3$ to $Li_2O$; and
b) mixing and heating said compounds at a temperature of about 1,100° C. to produce a scavenger $Li_2O.3TiO_2$ compound;

II) loading said scavenger $Li_2O.3TiO_2$ compound into one of two electrode baskets in a three electrode cell reactor and placing an Al-Li alloy in a second electrode basket of said three electrode cell reactor;

III) heating said cell to a temperature so that a mixture of KCl-LiCl contained in a crucible in said cell reaches its melting point and becomes a molten bath;

IV) immersing said baskets in said bath until an electrical connection is made between said baskets to charge said scavenger compound with Li until there is an initial current and voltage followed by a fall off ending current and voltage; and V) making a connection between the basket electrode containing engineered scavenger compound and a steel rod electrode disposed between said basket electrodes and applying a current to cause Li to leave the scavenger engineered compound and become electrodeposited on said steel rod electrode.

2. The process of claim 1, wherein in step III), ratios of said KCl-LiCl mixture are such that heating to provide a molten bath will be in a temperature range of between about 400° C. to about 750° C.

3. The process of claim 2, wherein in step V), the current to cause captured Li to leave the scavenger is between about 0.2 Ma to about 0.5 Ma at about 0.9 V DC.

4. The process of claim 3, wherein in step IV), the initial current is between about 2.1 to about 2.4 μA and the ending current is between about 0.3 to about 2.0 μA.

5. The process of claim 4, wherein the initial voltage is between about 430 mV to about 500 mV and the ending voltage is between about 74 mV to about 420 mV.

6. The process of claim 5, wherein said crucible is graphite.

7. The process of claim 1, except that said three electrode cell utilizes a molten Al-Li alloy and a solid scavenger compound in separate porous ceramic tubes surrounded by said molten salt bath as a primary reactor, and said scavenger compound is reactivated by electrodepositing Li on a removable electrode in a second reactor to make said scavenger compound ready for reuse in said primary reactor, as a continuous two reactor process.

* * * * *